United States Patent [19]

Todokoro

[11] 4,215,511

[45] Aug. 5, 1980

[54] TOY TELEVISION SET WITH MUSICAL BOX

[76] Inventor: Masatoshi Todokoro, 2-33, Koganehara 2-chome, Matsudo-shi, Chiba-ken, Japan

[21] Appl. No.: 932,763

[22] Filed: Aug. 11, 1978

[51] Int. Cl.[2] ..... A63H 5/00; G09F 11/06; G09F 11/04

[52] U.S. Cl. ..... 46/175 R; 40/475; 40/497; 46/1 R

[58] Field of Search ..... 46/175 R, 14, 1 R, 39; 40/475, 497

[56] References Cited

U.S. PATENT DOCUMENTS

| | | | |
|---|---|---|---|
| 1,848,296 | 3/1932 | Hueber | 40/475 |
| 2,130,428 | 9/1938 | Katz | 40/475 |
| 3,388,499 | 6/1968 | Mercorelli | 46/175 R |
| 3,402,490 | 9/1968 | Goldman et al. | 40/475 |
| 3,771,242 | 11/1973 | Lagasse et al. | 40/475 |
| 3,965,592 | 6/1976 | Amos | 40/475 |

*Primary Examiner*—Louis G. Mancene
*Assistant Examiner*—Michael J. Foycik, Jr.
*Attorney, Agent, or Firm*—George B. Oujevolk

[57] ABSTRACT

A toy television set with a musical box whereby words, television scenes on a plurality of leaves can be seen in succession through a transparent screen with the accompaniment of music played by the musical box. The device has a case modeled after the cabinet of a real TV set, a transparent screen on the front side of the case, a horizontal shaft disposed in the case in alignment with a line extending across the center of the screen, a musical box, a prime mover for driving the shaft and musical box, a pair of discs disposed at both ends of the horizontal shaft, each of the discs having a plurality of apertures along the periphery thereof, and a plurality of leaves on which pictures, words, etc., are drawn, each of said leaves having extending from both sides of the lower end of each leaf insert elements inserted into corresponding apertures in said discs.

4 Claims, 7 Drawing Figures

TOY TELEVISION SET WITH MUSICAL BOX

This invention relates to a toy television set with a musical box whereby the pictures, words, characters, etc., drawn on a plurality of leaves can be seen in succession through a transparent screen as the leaves are turned over successively, with the accompaniment of music played by the musical box.

The device of this invention is described in detail hereinbelow by way of an embodiment thereof with reference to the accompanying drawings, in which.

Figure 4:
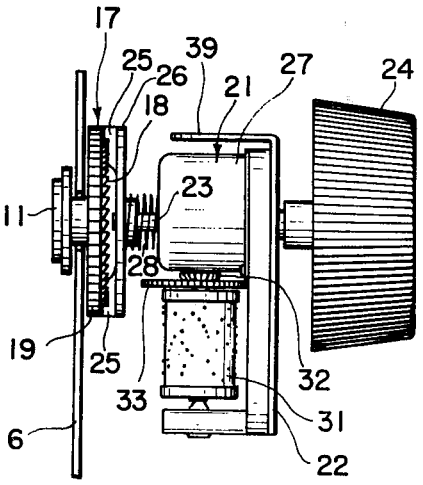
FIG. 4 is an enlarged top plan view showing the arrangement of the prime mover, musical box and clutch plate in the device.
Figure 5:
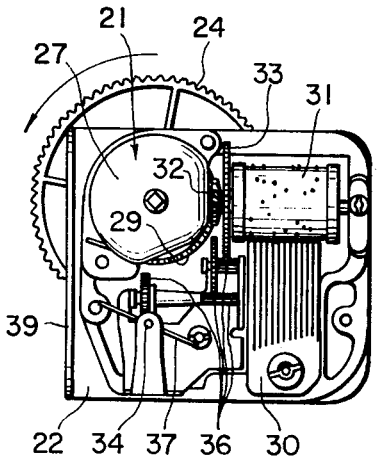
FIG. 5 is an enlarged side view showing the arrangement of the prime mover, musical box and reduction gearing in the device.

Referring generally to the drawings, numeral 1 designates a case modeled after the cabinet of a portable TV set. Said case 1 is mounted on its front side with a screen 2 made of a transparent plate having a lens effect and is open on its back side. The open side of the case 1 is covered with a back plate 3 which bulges out at its middle part to form a half-circular bulge 4 which is provided with a plurality of holes 5 imitating the vent holes in the TV set. Provided integrally on the interior of said back plate 3 are a pair of support plates 6 and 7 extending parallel to each other sidewise as viewed from the screen side of the case 1 and a bottom plate 8 mounted horizontally between the lower ends of said both support plates 6 and 7. A rotary shaft 9 is provided extending transversely in alignment with the line where the screen 2 is halved into the upper and lower half portions, with both ends of said shaft 9 being pivotally supported in the middle parts of said support plates 6 and 7. Secured to the parts of the shaft 9 positioned inside and close to the respective support plates 6 and 7 are the discs 11 and 12 each of which is formed with a plurality of holes 10 along the circumferential periphery thereof. Numeral 13 indicates a plurality of leaves each of which has a size corresponding to the half of the exposed area of the screen 2 so that the two half scenes on every two corresponding leaves present a complete scenes when such two leaves appear through the screen 2. That is, a picture, a word (or a paragraph of words), etc., is drawn in two portions, one on the rear side of a leaf and the other on the front side of the succeeding leaf, so that a series of pictures of, for example, vehicles or a story in pictures may be shown through the screen by turning over the leaves successively. Extending from both sides of the lower end of each of said leaves are insert elements 14 and 15 adapted to fit in the corresponding holes 10 in the discs 11 and 12 and supported around the shaft 9. 16 is a leaf engaging member like a plate spring of which one end is secured to an upper central part on the inside of the back plate 3 and the other end is arranged to engage with the upper end of each leaf 13 which has just turned up to its vertical position with rotation of the shaft 9. A disc clutch 17 is secured to the end of the shaft 9 which projects outside of one of the support plates 6, said disc clutch 17 is provided on its external side with a ratchet 18 designed to describe a circle about the shaft 9. It is also provided peripherally thereof with another ratchet 19 arranged in the same direction as said ratchet 18. Numeral 20 refers to a detent bar of which one end is secured to an upper inside part of the back plate 3 and the other end is engaged with the ratchet 19, and numeral 21 indicates a prime mover for giving rotative power to the shaft 9. This prime mover, as shown in FIGS. 4 and 5, has an angular driving shaft 23 loaded with a windup spring (not shown) and supported by a frame 22, with one end of said driving shaft 23 being secured to a grip 24 while the other end is slidably fitted in the central part of a circular driving plate 26 having pawls 25 engaged with the ratchet 18 on the disc plate 17, and a spring 28 is compressedly disposed between said driving plate 26 and a case 27 secured to the frame 22 in a way to cover said windup spring so as to press the pawls 25 of the driving plate 26 against the ratchet 18 on the clutch plate 17. A driving gear 29, which is a crown gear, is mounted through a clutch means (not shown) on that portion of the driving shaft 23 which extends inside of the case 27, said driving gear 29 being meshed with a smaller gear 32 secured to an end of the shaft of a rotary drum 31 of a musical box 30 supported to the frame 22. Also mounted on the shaft of said rotary drum 31 is a large gear 33 disposed between the small gear 32 and the drum 31, and a train of reduction gears 36 is provided between said large gear 33 and a worm 35 provided on a shaft 34 extending below and parallel to the driving shaft 23. Secured to said shaft 34 is a stopper member 37 which turns quickly and is low in torque, that is, which is capable of stopping rotation with a small force. The prime mover unit 21 is fixed in position on the inside of the side wall 38 of the case 1 opposed to the support plate 6 by pressedly attaching a fixing plate provided on at one end of the frame 22 against the protuberances 40 on the interior surface of the back plate 3 and driving the wood screws 42 through the holes 41 formed centrally in said respective protuberances 40. The driving shaft 23 extends out through a cutout 43 in the side wall 38 and the grip 24 is secured to the projecting end of said shaft 23. Also, a transmission plate 26 is pressed against the clutch plate 17 by a spring 28.

Denoted by numerals 44 and 45 are the grips provided protuberantly at a front side part of the case 1 close to its right-hand end. The upper grip 44 is a mere ornament, while the lower grip 45 is joined to an operating bar 46 which, when said grip 45 is turned to "OFF", is turned to the position where it contacts with the stopper 37 to stop operation of the prime mover 21, and when said grip is turned to "ON", said operating bar 46 is turned to the position remote from said contact position to release brake on the prime mover 21. 47 is a protuberance provided at the central part of the bottom plate 8 for receiving the lower edge of the leaf 13 which has just turned to the position which is vertically beneath the shaft 9 and opposes to the lower half portion of the screen 2. 48 indicates the protuberances extending inwardly from the inside corners of the front portion of the case 1, each of said protuberances 48 having at its end portion an internal threaded hole and arranged such that corresponding one of the similar hollow protuberances 49 extending inwardly from the inside corners of the back plate 3 is butted against said protuberance 48 and a screw 50 inserted into the hollow portion of each said protuberance 49 is driven into the internal threaded hole of the corresponding protuberance 48, thereby securely joining the case 1 to the back plate 3.

Now the operation of the toy television set with a musical box according to this invention is described.

When the grip 45 is first turned to "ON" and then the grip 24 is turned in the direction of arrow in FIG. 5, the driving shaft 23 is accordingly turned in the same direction to wind up the windup spring in the case 27 to accumulate the rotative power. Concurrently with this, the clutch between the driving shaft 23 and driving gear 29 is disengaged to keep the driving gear 29 in a stationary state, allowing the small gear 32 to stay still, too, so that said rotation of the driving shaft 23 is not transmitted to the rotary drum 31 of the musical box 30 nor to the reduction gear train 36. Although the transmission plate 26 turns with said rotation of the driving shaft 23, the pawls 25 of said plate 26 slide idly over the ratchet 18 of the clutch plate 17 and the stopper bar 20 is engaged with the ratchet 19 of the clutch plate 17 to lock the clutch plate 17, so that said rotation of the transmission plate 26 is not transmitted to the shaft 9.

Figure 1:
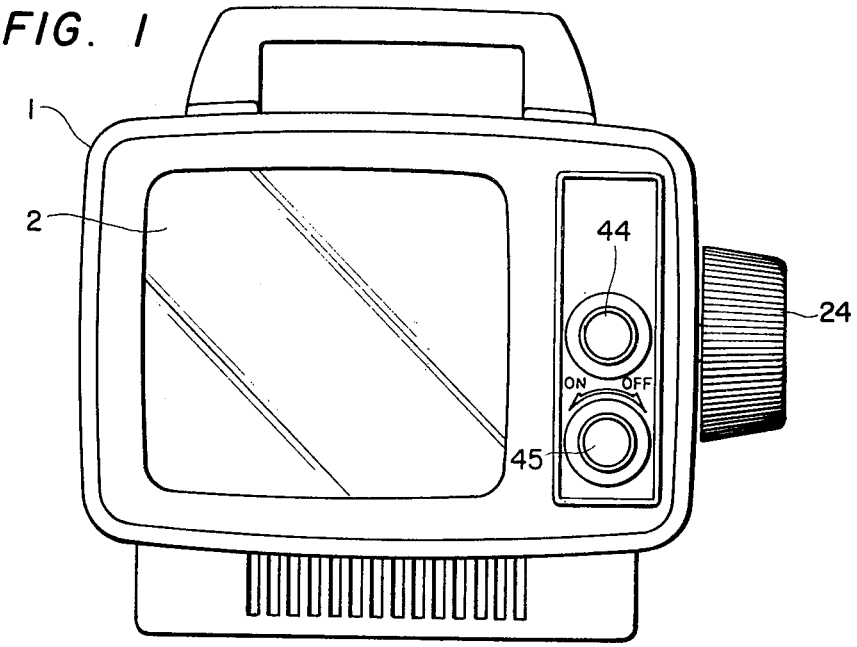
FIG. 1 is a frontal view of a toy television set with a musical box according to this invention.
Figure 2:
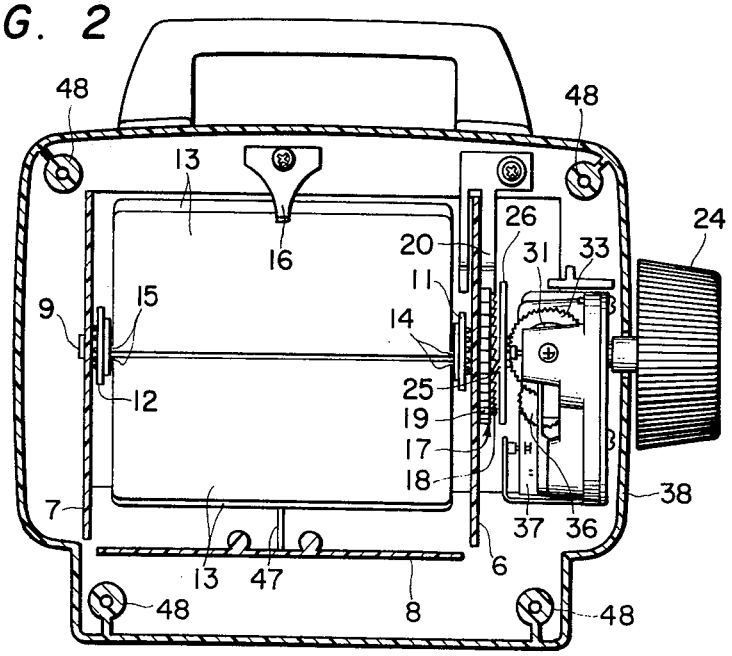
FIG. 2 is a frontal view of the device, with parts cut away.
Figure 3:
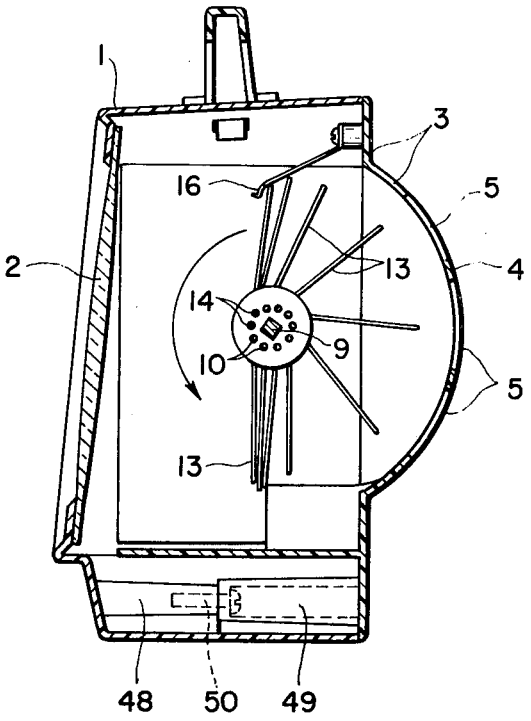
FIG. 3 is a side elevational view of the device, with parts cut away.
Figure 6:
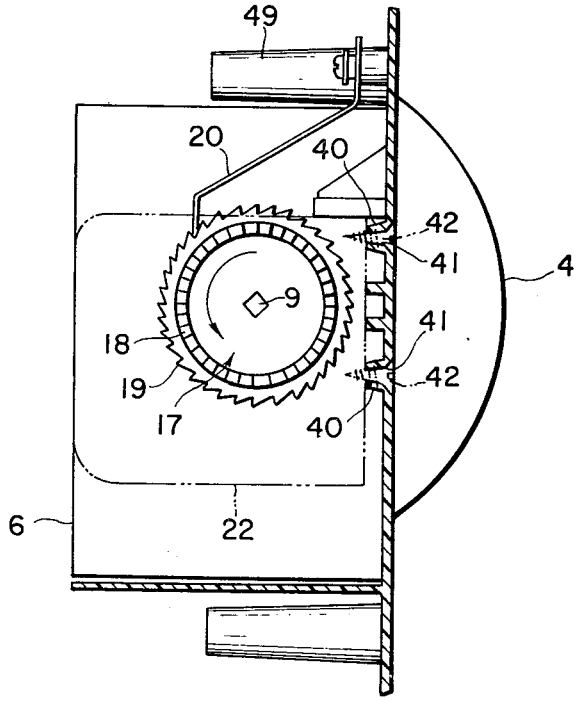
FIG. 6 is an enlarged side view showing the mounted condition of the clutch plate.

When the hold on the grip 24 is released at a point when the rotative power has been sufficiently accumulated on the windup spring, such rotative power is transmitted to the driving shaft 23 to let it turn contrariwise to the direction of said rotation, whereupon the clutch mounted between the driving shaft 23 and driving gear 29 is engaged to allow rotation of the driving gear 29, which rotation is transmitted through the small gear 32 and large gear 33 to the reduction gear train 36 and is thereby reduced in speed, so that the transmission plate 26 and drum 31 are rotated at reduced speed. Also, the pawls 25 of the transmission plate 26 are engaged with the ratchet 18 of the clutch plate 17 while the stopper bar 20 slides over the ratchet 19 to let the clutch plate 17 turn in the direction of arrow in FIG. 6, so that the rotative power is now transmitted to the shaft 9 to let it rotate, causing the leaves 13 to turn accordingly in the direction of arrow in FIG. 3. Thus, the leaves 13 rise up successively to the position of the leaf engaging member 16, then come off it and are thereby turned over, so that the plurality of pictures, words, etc., appear in succession on a magnified scale on the screen 2. At the same time, the small protuberances on the peripheral surface of the drum 31 hit the gamut plates of the musical device 30 to play a music.

Figure 7:
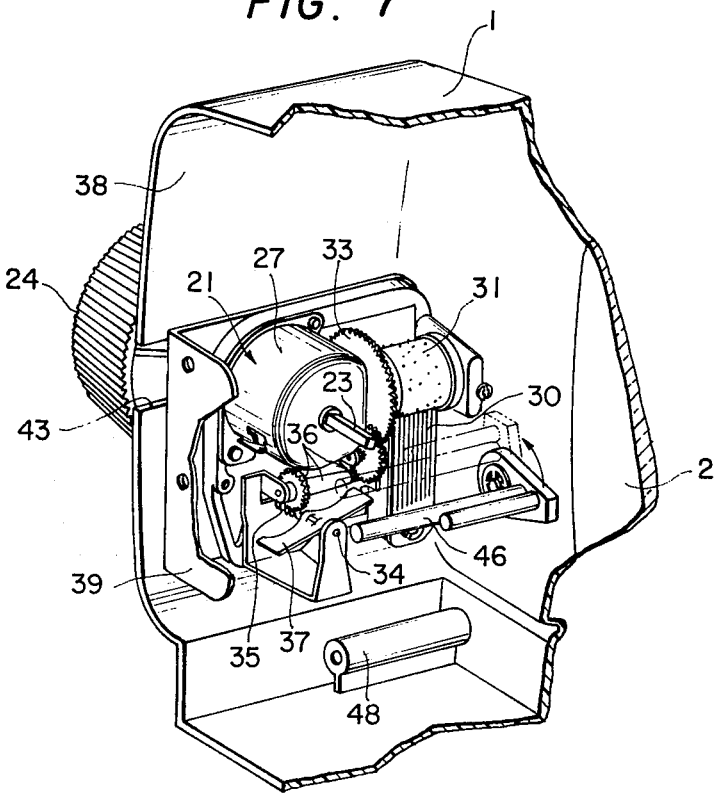
FIG. 7 is a partial perspective view of the device with the back plate removed.

If the grip 45 is turned to "OFF" in the course of movement of the leaves 13 and drum 31, the operating bar 46 shifts to the position of solid line in FIG. 7 and its end contacts with the quickly turning stopper member 37, whereby the operation of the reduction gear train 36 and prime mover 21 is stopped to accordingly stop movement of the leaves 13 and play of the musical device 30.

If the grip 45 is turned to "ON", the prime mover 21 resumes its operation to again start movement of the leaves 13 and play of the musical box 30, with such operation being continued until the accumulated rotative power is used up.

In the foregoing embodiment of the invention, a transparent plate having a lens effect is used for the screen, but it is possible to use a transparent plate having no such lens effect. Also, a motor may be employed as prime mover instead of the clockwork used in the shown embodiment.

Thus, according to the device of this invention which has the just described mechanism, when the prime mover is operated the leaves move on successively and many pictures, etc., appear in succession through the screen on the front side of the case with the accompaniment of music just like a real TV set, so that the children can enjoy viewing the successively changing scenes on the screen while hearing the music played by the musical box incorporated in the device.

What is claimed is:

1. A toy television set with a musical box, comprising in combination:

(a) a case modeled after the cabinet of a television set;

(b) a transparent rectangular screen at the front side of said case;

(c) a horizontal shaft disposed in the case in alignment with a line extending across the center of the screen and parallel thereto;

(d) a music box in said cabinet with a rotary drum;

(e) a prime mover coupled for driving said shaft and said drum;

(f) a pair of discs at both ends of said shaft, each of said discs being formed with a plurality of apertures along the periphery thereof;

(g) a plurality of substantially identically sized radially disposed display rectangular leaves, each of which is sized to about one-half of said screen and contains on both sides thereof matter to simulate one-half of a television scene so that the back of one leaf and the front of the next leaf provide one full scene, each leaf having a defined inner end;

(h) insert elements extending from both sides of said inner ends, said elements being inserted into corresponding disc apertures; and, (i) a clutch plate disposed at one end of said horizontal shaft, said prime mover being a windup spring prime mover, and a central driving shaft, a driving plate with pawls engaged with said clutch plate secured to one end of said driving shaft, a grip extending outside said case coupled to said prime mover windup spring for winding up said spring by turning said grip.

2. A toy according to claim 1 wherein a driving gear is mounted on said driving shaft in engagement with a reduction gear train.

3. A toy according to claim 2 wherein a stopper member is coupled to said gear train and an operating bar engages said stopper member, said operating bar having a freely turnable outside knob.

4. A toy television set with a musical box according to claim 3, further comprising a ratchet disposed around the clutch plate and a detent bar disposed to engage with said ratchet to lock the clutch plate against its turning motion when said clutch plate is urged to turn in the direction of unwinding of said prime mover windup spring.

* * * * *